US009815115B2

(12) United States Patent
Sakaguchi et al.

(10) Patent No.: US 9,815,115 B2
(45) Date of Patent: Nov. 14, 2017

(54) FINISH HEAT TREATMENT METHOD AND FINISH HEAT TREATMENT APPARATUS FOR IRON POWDER

(71) Applicant: JFE STEEL CORPORATION, Tokyo (JP)

(72) Inventors: Yasuhiko Sakaguchi, Chiba (JP); Toshio Maetani, Chiba (JP)

(73) Assignee: JFE STEEL CORPORATION, Tokyo (JP)

( * ) Notice: Subject to any disclaimer, the term of this patent is extended or adjusted under 35 U.S.C. 154(b) by 72 days.

(21) Appl. No.: 14/987,117

(22) Filed: Jan. 4, 2016

(65) Prior Publication Data

US 2016/0114391 A1 Apr. 28, 2016

Related U.S. Application Data

(62) Division of application No. 13/984,409, filed as application No. PCT/JP2011/079751 on Dec. 15, 2011, now Pat. No. 9,321,103.

(30) Foreign Application Priority Data

Mar. 23, 2011 (JP) ..... 2011-064059
Oct. 21, 2011 (JP) ..... 2011-231474

(51) Int. Cl.
*F27B 9/04* (2006.01)
*B22F 1/00* (2006.01)
(Continued)

(52) U.S. Cl.
CPC ..... *B22F 1/0088* (2013.01); *B22F 1/0003* (2013.01); *B22F 1/0081* (2013.01);
(Continued)

(58) Field of Classification Search
CPC ..... F27B 9/045; F27B 9/243
(Continued)

(56) References Cited

U.S. PATENT DOCUMENTS 9,321,103 B2 * 4/2016 Sakaguchi ..... B22F 1/0088

FOREIGN PATENT DOCUMENTS

JP 52-156714 12/1977
JP 64-040881 2/1989
(Continued)

OTHER PUBLICATIONS

Apr. 10, 2012 Search Report issued in International Patent Application No. PCT/JP2011/079751.
(Continued)

*Primary Examiner* — Scott Kastler
(74) *Attorney, Agent, or Firm* — Oliff PLC

(57) ABSTRACT

A finish heat treatment apparatus for an iron powder. Raw iron powder is placed on a continuous moving hearth and continuously charged into the apparatus. In a pretreatment zone, the raw iron powder is subjected to a pretreatment of heating the raw iron powder in an atmosphere of hydrogen gas and/or inert gas at 450 to 1100° C. In decarburization, deoxidation, and denitrification zones, the pretreated iron powder is subsequently subjected to at least two treatments of decarburization, deoxidation, and denitrification. In the pretreatment zone, a hydrogen gas and/or an inert gas serving as a pretreatment ambient gas is introduced separately from an ambient gas used in the at least two treatments is introduced from the upstream side of the pretreatment zone and released from the downstream side so as to flow in the same direction as a moving direction of the moving hearth.

1 Claim, 1 Drawing Sheet

(51) Int. Cl.

| | |
|---|---|
| ***F27B 9/24*** | (2006.01) |
| ***C21D 1/74*** | (2006.01) |
| ***C21D 3/02*** | (2006.01) |
| ***C21D 3/04*** | (2006.01) |
| ***C21D 3/08*** | (2006.01) |
| ***F27B 9/02*** | (2006.01) |
| ***F27D 7/02*** | (2006.01) |

(52) U.S. Cl.
CPC ..... *B22F 1/0085* (2013.01); *C21D 1/74* (2013.01); *C21D 3/02* (2013.01); *C21D 3/04* (2013.01); *C21D 3/08* (2013.01); *F27B 9/028* (2013.01); *F27B 9/045* (2013.01); *F27B 9/047* (2013.01); *F27B 9/243* (2013.01); *F27D 7/02* (2013.01); *B22F 2201/013* (2013.01); *B22F 2201/10* (2013.01); *B22F 2201/32* (2013.01); *B22F 2301/35* (2013.01)

(58) Field of Classification Search
USPC ..... 266/177, 176
See application file for complete search history.

(56) References Cited

FOREIGN PATENT DOCUMENTS

| | | |
|---|---|---|
| JP | 04-009402 | 1/1992 |
| JP | 2006-009138 | 1/2006 |
| JP | 2007-211302 | 8/2007 |
| JP | 2010-159474 | 7/2010 |

OTHER PUBLICATIONS

Apr. 20, 2017 Office Action issued in European Patent Application No. 11861736.4.

* cited by examiner

FINISH HEAT TREATMENT METHOD AND FINISH HEAT TREATMENT APPARATUS FOR IRON POWDER

CROSS REFERENCE TO RELATED APPLICATION

This application is a divisional application of U.S. application Ser. No. 13/984,409, filed Aug. 8, 2013 (now U.S. Pat. No. 9,321,103), which is National Stage Application of International Application No. PCT/JP2011/079751, filed Dec. 15, 2011, the contents of which are incorporated herein by reference.

BACKGROUND OF THE INVENTION

1. Field of the Invention

The present invention relates to a heat treatment for producing an iron powder that is directly used in the form of a powder or is used for powder metallurgy. In particular, the present invention relates to a finish heat treatment method for an iron powder in which a product iron powder is obtained by subjecting a raw iron powder to at least two treatments selected from decarburization, deoxidation, and denitrification, and to a finish heat treatment apparatus used in the method.

2. Description of the Related Art

A raw iron powder such as a rough-reduced iron powder obtained by rough-reducing a mill scale or an as-atomized iron powder has been conventionally subjected to a finish heat treatment to obtain a product iron powder. In the finish heat treatment, at least one treatment selected from decarburization, deoxidation, and denitrification is performed on the raw iron powder in accordance with the applications of the product iron powder. Normally, the finish heat treatment is continuously performed using a moving hearth furnace.

For example, Japanese Unexamined Patent Application Publication No. 52-156714 (Patent Document 1) discloses a method for heat-treating a raw material iron powder in which, when a raw material iron powder is subjected to a continuous heat treatment in an ambient gas mainly composed of a hydrogen gas in order to obtain a reduced iron powder, the ambient temperature of the heat treatment is kept at 800 to 950° C., the heat treatment in the first half is performed in a decarburizing atmosphere having a water content of 6% or more by volume, and the heat treatment in the second half is performed in a reducing atmosphere having a water content of 4% or less by volume.

Japanese Examined Patent Application Publication No. 01-40881 (Patent Document 2) discloses a continuous moving hearth furnace in which a moving hearth furnace is partitioned into a plurality of spaces with partition walls that are disposed in a direction perpendicular to the raw material moving direction; a gas passageway is formed in the partitioned spaces so that a gas flows in a direction opposite to the moving direction of the moving hearth; and a gas stirring apparatus is disposed on the upper portion of each of the spaces. In the technology disclosed in Patent Document 2, with this continuous moving hearth furnace, a finish heat treatment is performed on a steel powder by continuously performing two or more treatments selected from decarburization, deoxidation, and denitrification. In this technology, the treatments of the decarburization, the deoxidation, and the denitrification are independently performed in the partitioned spaces of the moving hearth furnace. The temperatures of these treatments are independently controlled to 600 to 1100° C. in the decarburization, 700 to 1100° C. in the deoxidation, and 450 to 750° C. in the denitrification.

FIG. 2 shows a finish heat treatment apparatus of the same type as the continuous moving hearth furnace disclosed in Patent Document 2. The finish heat treatment apparatus shown in FIG. 2 includes a furnace body 30 partitioned with partition walls 1 into a plurality of zones, that is, a decarburization zone 2, a deoxidation zone 3, and a denitrification zone 4, a hopper 8 disposed on the entry side of the furnace body 30, wheels 10 disposed on the entry side and exit side of the furnace body 30, a belt 9 that is continuously rotated by the wheels 10 and moves around each of the zones of the furnace body 30, and radiant tubes 11. A raw iron powder 7 supplied from the hopper 8 onto the belt 9 that continuously moves due to the continuous rotation of the wheels 10 is heat-treated while moving in the zones 2, 3, and 4 that are heated to proper temperatures with the radiant tubes 11. As a result, the raw iron powder 7 is subjected to decarburization, deoxidation, and denitrification and thus a product iron powder 71 is obtained. In the technology disclosed in Patent Document 2, the reaction in each of the zones is believed to be as follows.

In the decarburization zone 2, the decarburization of the raw powder is performed by controlling the ambient temperature to 600 to 1100° C. using the radiant tubes 11 and by controlling the dew point of the ambient to 30 to 60° C. by adding water vapor ($H_2O$ gas) introduced from a water vapor blowing inlet 12 disposed on the downstream side of the decarburization zone 2 to an ambient gas sent from the deoxidation zone 3. An ambient gas outlet 6 is disposed on the upstream side of the decarburization zone 2 and thus the ambient gas is released to the outside of the apparatus.

In the deoxidation zone 3, the deoxidation of the raw powder is performed by controlling the ambient temperature to 700 to 1100° C. using the radiant tubes 11 and by providing an ambient gas (a hydrogen gas having a dew point of 40° C. or less) sent from the denitrification zone 4.

In the denitrification zone 4, the denitrification of the raw powder is performed by controlling the ambient temperature to 450 to 750° C. using the radiant tubes 11 and by introducing a hydrogen gas (dew point: 40° C. or less), which is a reactant gas, from an ambient gas inlet 5 disposed on the downstream side of this denitrification zone 4.

SUMMARY OF THE INVENTION

However, the technology disclosed in Patent Document 1 poses a problem in that the decarburization and deoxidation of a raw iron powder can be performed, but the content of nitrogen cannot be reduced. Furthermore, in the technologies disclosed in Patent Documents 1 and 2, the contents of C and O sometimes cannot be reduced to the respective target contents in a single treatment if the contents of C and O of the raw iron powder are high. Therefore, the amount of the raw iron powder treated in a single treatment needs to be reduced or the treatment needs to be performed twice, which poses a problem in that the productivity of a product iron powder is decreased.

The present invention advantageously solves the problems of the related art and provides a finish heat treatment method and a finish heat treatment apparatus for an iron powder in which the contents of C, O, and N of a product iron powder can be easily and stably adjusted to desired target contents, regardless of the C, O, and N concentrations of a raw iron powder serving as a raw material iron powder.

In view of the foregoing, the inventors of the present invention have eagerly examined factors that affect the promotion of decarburization, deoxidation, and denitrification reactions. Consequently, the inventors have conceived that, to reduce the reaction load in each of the decarburization, deoxidation, and denitrification zones of the finish heat treatment apparatus, a region (pretreatment zone) where a pretreatment is performed is further formed in the finish heat treatment apparatus with a partition wall as a space where part of the decarburization, deoxidation, and denitrification reactions can be caused to proceed. As a result of further examination, the inventors have found that, when a raw iron powder is heated in a temperature range of 700° C. or more in an inert gas or hydrogen gas atmosphere, C and O in the raw iron powder are bonded to each other through the following reaction and thus the contents of C and O in the raw iron powder can be reduced.

$$C(\text{in Fe})+FeO(s)=Fe(s)+CO(g)$$

Furthermore, the inventors have come to realize that, when heating is performed in a temperature range of 450 to 750° C. and a hydrogen gas is employed as the ambient gas, a denitrification reaction is also caused and thus denitrification can be performed. In the case where denitrification is not required, the ambient gas may be an inert gas.

Moreover, the inventors have found the following. For the promotion of reactions, it is important that the gas used as an ambient gas in the pretreatment zone is not a gas used in the decarburization zone or the like, but is a fresh gas that is newly introduced to the pretreatment zone. Therefore, an another ambient gas inlet needs to be disposed on the upstream side of the pretreatment zone. This is because, if the ambient gas used in the pretreatment zone contains a reaction product gas such as a CO gas or a $H_2O$ gas, the reactions in the pretreatment zone are inhibited. Thus, the ambient gas used in the pretreatment zone needs to be a fresh gas that does not contain a reaction product gas such as a CO gas or a $H_2O$ gas.

The present invention is based on these findings and has been completed through further investigation. The gist of the present invention is as follows.

(1) A finish heat treatment method for an iron powder includes placing a raw iron powder on a continuous moving hearth; subjecting the raw iron powder to a pretreatment of heating the raw iron powder in an atmosphere of a hydrogen gas and/or an inert gas; and then continuously subjecting the pretreated iron powder to at least two treatments selected from decarburization, deoxidation, and denitrification to obtain a product iron powder.

(2) In the method according to (1), the heating in the pretreatment may be performed at an ambient temperature of 450 to 1100° C.

(3) In the method according to (1) or (2), the hydrogen gas and/or the inert gas used as an ambient gas in the pretreatment may be introduced separately from an ambient gas used in the at least two treatments, and may be introduced from the upstream side of a region where the pretreatment is performed and released from the downstream side of the region so as to flow in the same direction as a moving direction of the continuous moving hearth.

(4) A finish heat treatment apparatus for an iron powder includes a hopper; a moving hearth on which a raw iron powder discharged from the hopper is placed and that continuously moves in an internal space of a furnace body; partition walls disposed in a direction perpendicular to a moving direction of the moving hearth so as to allow the moving hearth to pass therethrough; three spaces respectively constituted by a decarburization zone, a deoxidation zone, and a denitrification zone formed in that order from the upstream side in the moving direction of the moving hearth, the three spaces being formed by partitioning the internal space of the furnace body in a longitudinal direction with the partition walls, wherein the raw iron powder is subjected to finish heat treatment in each of the spaces; a pretreatment zone formed by partitioning the internal space of the furnace body with one of the partition walls that allows the moving hearth to pass therethrough, the pretreatment zone being adjacent to the upstream side of the decarburization zone; a plurality of radiant tubes disposed in each of the three spaces and the pretreatment zone to heat the three spaces and the pretreatment zone; an ambient gas inlet and an ambient gas outlet disposed on the downstream side of the denitrification zone and on the upstream side of the decarburization zone, respectively, to form a gas passageway in the three spaces so that an ambient gas flows in a direction opposite to the moving direction of the moving hearth; a water vapor blowing inlet disposed on the downstream side of the decarburization zone to adjust an ambient dew point; and a pretreatment ambient gas inlet disposed on the upstream side of the pretreatment zone.

(5) In the apparatus according to (4), the pretreatment ambient gas inlet disposed on the upstream side of the pretreatment zone may be configured in a manner of allowing a hydrogen gas and/or an inert gas to be introduced as an ambient gas from the pretreatment ambient gas inlet.

According to the present invention, a product iron powder having desired C, O, and N concentrations can be easily and stably produced with high productivity, regardless of the C, O, and N concentrations of a raw iron powder serving as a raw material iron powder, which produces industrially significant effects. Furthermore, according to the present invention, a product iron powder having a stable quality can be provided.

DESCRIPTION OF THE PREFERRED EMBODIMENTS

Figure 1:
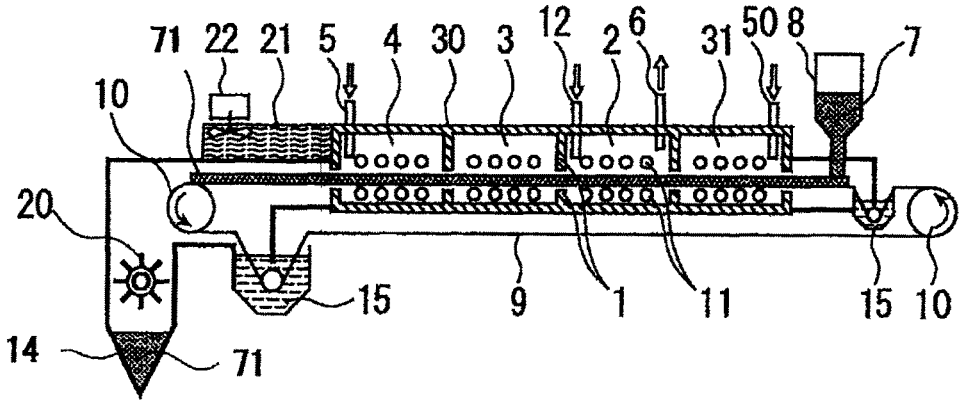
FIG. 1 is a sectional side view schematically showing a finish heat treatment apparatus according to the present invention.
Figure 2:
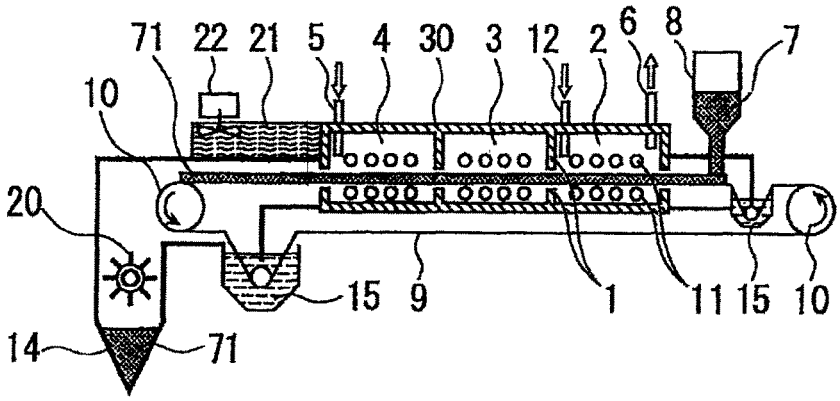
Fig. 2 (Related Art)
FIG. 2 is a sectional side view schematically showing a conventional finish heat treatment apparatus.

FIG. 1 schematically shows an example of a finish heat treatment apparatus according to the present invention. The finish heat treatment apparatus according to the present invention includes a furnace body 30, a hopper 8, a moving hearth 9 (a belt in FIG. 1) that continuously moves in the furnace body 30, and three spaces (2, 3, and 4 in FIG. 1) formed in the furnace body 30 and partitioned with a plurality of partition walls 1 disposed in a direction perpendicular to the moving direction of the moving hearth 9. The finish heat treatment apparatus further includes a pretreatment zone 31, which is a space for pretreatment, partitioned with a partition wall 1 and formed on the upstream side of the three spaces. Obviously, a plurality of radiant tubes 11 for heating are disposed in each of the three spaces 2, 3, and 4 and the pretreatment zone 31. To reduce the load of decarburization, deoxidation, and denitrification treatments performed later in the respective three spaces, part of the decarburization, deoxidation, and denitrification treatments is performed in the pretreatment zone 31 as a pretreatment.

A raw iron powder 7 stored in the hopper 8 is discharged from the hopper 8 and placed on the moving hearth 9. The raw iron powder 7 is charged into the pretreatment zone 31 and subjected to a pretreatment. In FIG. 1, the moving hearth 9 is a belt that can be continuously moved by a pair of wheels 10 rotated by driving means (not shown), but is not limited thereto in the present invention. A system in which a tray is moved with a pusher or on a roller may be employed.

The spaces in the furnace body 30 are partitioned with the partition walls 1 as described above, but each of the partition walls 1 has an opening so that the moving hearth 9 can pass through the partition wall 1. A gas passageway of ambient gas can be formed between the adjacent spaces through the opening. In the finish heat treatment apparatus according to the present invention, an ambient gas outlet 6 is disposed on the upstream side of the space 2 in the moving direction of the moving hearth 9 so that the ambient gas used in the three spaces 2, 3, and 4 does not flow into the pretreatment zone 31. A pretreatment ambient gas inlet 50 is disposed on the upstream side of the pretreatment zone 31, and the ambient gas used in the pretreatment zone 31 is released through an opening formed on the downstream side of the pretreatment zone 31. A gas introduced from the pretreatment ambient gas inlet 50 disposed in the pretreatment zone 31 is an inert gas and/or a hydrogen gas in accordance with the treatment performed in the pretreatment zone 31. The ambient gas used in the pretreatment zone 31 is released to the outside of the furnace body 30 from the ambient gas outlet 6 together with the ambient gas used in the three spaces.

In the finish heat treatment apparatus according to the present invention, the three spaces 2, 3, and 4 are formed so that at least two treatments selected from decarburization, deoxidation, and denitrification can be performed according to need. Furthermore, in order to achieve ambient temperature suitable to each of the treatments, radiant tubes 11, which are heating means, are disposed in the three spaces so that the heating in each of the spaces can be independently controlled. Thus, the reaction rate in each of the treatments is increased, and desired finish heat treatment of the raw iron powder can be promptly performed.

In the case where all the treatments of decarburization, deoxidation, and denitrification are performed in the three spaces 2, 3, and 4 in the furnace body 30, as shown in FIG. 1, the three spaces are preferably constituted by a decarburization zone 2, a deoxidation zone 3, and a denitrification zone 4, respectively, formed in that order from the upstream side in the moving direction of the moving hearth 9, the decarburization zone 2 being adjacent to the downstream side of the pretreatment zone 31. In such an arrangement, each of the treatments can be continuously and efficiently performed. By disposing an ambient gas inlet 5 on the downstream side of the denitrification zone 4 and disposing the ambient gas outlet 6 on the upstream side of the decarburization zone 2, a gas can be caused to flow in a countercurrent manner, that is, in a direction opposite to the moving direction of the raw iron powder 7 placed on the moving hearth 9. As a result, the efficiency of the treatments can be improved. Herein, a reducing gas (hydrogen gas) mainly composed of a hydrogen gas is introduced from the ambient gas inlet 5 as in Patent Document 2. A water vapor blowing inlet 12 that allows the ambient dew point to be adjusted by blowing water vapor into the atmosphere of the decarburization zone 2 is disposed on the downstream side of the decarburization zone 2.

In the case where the decarburization treatment is not required due to the composition of the raw iron powder, the decarburization zone 2 can be used as a deoxidation zone by stopping blowing water vapor from the water vapor blowing inlet 12 and adjusting the ambient temperature to a temperature suitable to the deoxidation treatment. In the case where the deoxidation treatment is not required, the deoxidation zone 3 can be used as a denitrification zone by adjusting the ambient temperature to a temperature suitable to the denitrification treatment. In the case where the denitrification treatment is not required, the denitrification zone 4 can be used as a deoxidation zone by adjusting the ambient temperature to a temperature suitable to the deoxidation treatment.

In the finish heat treatment apparatus according to the present invention, unused gases of the hydrogen gas and water vapor introduced or reaction product gases are released to the outside of the furnace body 30 from the ambient gas outlet 6 disposed on the upstream side of the decarburization zone 2. A product iron powder 71 subjected to a finish heat treatment is cooled with a cooler 21 and further cooled by, for example, blowing a hydrogen gas with a circulation fan 22. Subsequently, the product iron powder 71 is crushed to have a certain particle size with a crusher 20 and stored in a tank 14. The atmosphere in the furnace body 30 is isolated from the outside atmosphere through a water seal tank 15 or the like so that the reaction of each of the treatments is not inhibited.

In the present invention, a raw iron powder is subjected to a finish heat treatment preferably using the above-described finish heat treatment apparatus according to the present invention to obtain a product iron powder.

A finish heat treatment method for an iron powder according to the present invention will now be described. In the finish heat treatment method for an iron powder according to the present invention, a raw iron powder such as a rough-reduced iron powder obtained by rough-reducing a mill scale or an as-atomized iron powder is used as a starting material.

In the present invention, a raw iron powder, which is a starting material, is placed on a continuous moving hearth. Subsequently, the raw iron powder is subjected to a pretreatment and furthermore at least two treatments selected from decarburization, deoxidation, and denitrification treatments while being continuously moved. Thus, a product iron powder is obtained. The at least two treatments selected from decarburization, deoxidation, and denitrification treatments can be suitably selected in accordance with the C, O, and N concentrations of the raw iron powder or the applications of the product iron powder.

In the present invention, the pretreatment is performed, for example, in the pretreatment zone 31 shown in FIG. 1 to remove part of impurity elements such as carbon, oxygen, and nitrogen in advance. The pretreatment in the present invention is performed prior to the decarburization, deoxidation, and denitrification treatments in order to reduce the loads of the decarburization treatment performed in the decarburization zone 2, the deoxidation treatment performed in the deoxidation zone 3, and the denitrification treatment performed in the denitrification zone 4, improve the productivity of the finish heat treatment, and stabilize the quality of the product iron powder.

The pretreatment in the present invention is performed after the raw iron powder 7, which has been discharged from the hopper 8 and placed on the moving hearth 9, is moved into the pretreatment zone 31 where the temperature is controlled in a predetermined temperature range. The pretreatment zone 31 is preferably heated to 450 to 1100° C. and has a hydrogen gas and/or inert gas atmosphere. The ambient dew point in the pretreatment zone 31 is 40° C. or less.

In this pretreatment, the decarburization and deoxidation can be performed on the raw iron powder through the following reaction:

$$C(\text{in Fe})+FeO(s)=Fe(s)+CO(g)$$

where s represents solid and g represents gas. This reaction proceeds at 700° C. or more using either an inert gas or a hydrogen gas as an ambient gas. Further, before reaching to the temperature suitable for the decarburization and deoxidation, the denitrification of the raw iron powder can also be performed at a temperature range of 450 to 750° C. through the following reaction if a hydrogen gas is employed as the ambient gas.

$$N(\text{in Fe})+3/2H_2(g)=NH_3(g)$$

Therefore, when denitrification is desired, the ambient gas needs to be a hydrogen gas.

If a gas used as the ambient gas of the pretreatment zone contains a reaction product gas such as a CO gas, the decarburization and deoxidation reactions in the pretreatment are inhibited. Thus, for the purpose of facilitating the reactions in the pretreatment, it is important that the gas used as the ambient gas of the pretreatment zone is not an ambient gas used in the downstream decarburization zone or the like, but a fresh gas that does not contain a CO gas and is newly introduced to the pretreatment zone 31 from the pretreatment ambient gas inlet 50 disposed on the upstream side of the pretreatment zone 31.

The raw iron powder 7 subjected to the pretreatment in the pretreatment zone 31 is subjected to at least two treatments selected from the decarburization treatment, the deoxidation treatment, and the denitrification treatment in the decarburization zone 2, the deoxidation zone 3, and the denitrification zone 4, respectively, in accordance with the C, N, and O contents of the raw iron powder or the applications of the product iron powder. Thus, a product iron powder is obtained.

In the decarburization zone 2, the decarburization treatment of the raw iron powder is performed by controlling the ambient temperature to 600 to 1100° C. using the radiant tubes 11 and by controlling the dew point to 30 to 60° C. by adding water vapor ($H_2O$ gas) introduced from the water vapor blowing inlet 12 to a reducing gas (hydrogen gas) that is mainly composed of a hydrogen gas and sent from the downstream deoxidation zone 3 through the opening of the partition wall 1. In the decarburization zone 2, the decarburization of the raw iron powder is performed through the following reaction.

$$C(\text{in Fe})+H_2O(g)=CO(g)+H_2(g)$$

In the deoxidation zone 3, the deoxidation treatment of the raw iron powder is performed by controlling the ambient temperature to 700 to 1100° C. using the radiant tubes 11 and by providing an ambient gas (a reducing gas (hydrogen gas) mainly composed of a hydrogen gas and having a dew point: 40° C. or less and preferably room temperature or less) sent from the downstream denitrification zone 4 through the opening of the partition wall 1. In the deoxidation zone 3, the deoxidation is performed through the following reaction.

$$FeO(s)+H_2(g)=Fe(s)+H_2O(g)$$

In the denitrification zone 4, the denitrification treatment of the raw iron powder is performed by controlling the ambient temperature to 450 to 750° C. using the radiant tubes 11 and by introducing a reducing gas mainly composed of a hydrogen gas from the ambient gas inlet 5 disposed on the downstream side of this zone 4. In the denitrification zone 4, the denitrification is performed through the following reaction.

$$N(\text{in Fe})+3/2H_2(g)=NH_3(g)$$

The present invention will now be further described based on Examples.

Examples

Raw iron powders A, B, C, and D each having the impurity element (C, O, N) content shown in Table 2 were prepared as starting materials. The raw iron powders A, B, C, and D were subjected to a finish heat treatment under the conditions shown in Table 1 using the finish heat treatment apparatus of the present invention shown in FIG. 1 to obtain product iron powders. Note that water-atomized iron powders having a particle size of 100 μm or less were used as the raw iron powders.

In Invention Examples, each of the raw iron powders was discharged from the hopper 8 and placed on the belt 9, which was a continuous moving hearth, so as to have a thickness of 40 mm. The raw iron powder was then continuously subjected to the finish heat treatment constituted by the pretreatment in the pretreatment zone 31, the decarburization treatment in the decarburization zone 2, the deoxidation treatment in the deoxidation zone 3, and the denitrification treatment in the denitrification zone 4. Table 1 also shows the treatment temperature, the type and flow rate of ambient gas, and the charged amount in each of the zones. The ambient gas in the decarburization zone 2, deoxidation zone 3, and denitrification zone 4 was introduced from the ambient gas inlet 5 disposed on the downstream side of the denitrification zone 4 and supplied to each of the zones through the gas passageway that passes through the opening of the partition wall of each of the zones so as to flow in a direction opposite to the moving direction of the belt 9. In Comparative Examples, the pretreatment zone 31 was not used.

By analyzing the resultant product iron powder, the contents of carbon, oxygen, and nitrogen were determined. Furthermore, the impurity content of the product iron powder of heat treatment No. 4 was assumed to be a reference value. If the impurity content was much higher than the reference value, "poor" was given, which means that the quality of the product iron powder was poor. In other cases, "good" was given. Herein, in these Examples, the charged amount per unit time was adjusted so that "good" was given in terms of the quality of the product iron powder.

Moreover, the charged amount of heat treatment No. 4 was assumed to be a reference value (1.00). If the charged amount (produced amount) per unit time was significantly decreased (less than 0.90) compared with the reference value, "poor" was given, which means that the productivity was poor. In other cases, "good" was given. Table 2 shows the results.

TABLE 1

| Heat treatment No. | Raw iron powder No. | Raw iron powder Thickness when placed (mm) | Conditions of finish heat treatment: Pretreatment zone Temperature at zone exit (° C.) | Pretreatment zone Ambient gas Type | Pretreatment zone Ambient gas Dew point (° C.) | Pretreatment zone Ambient gas Flow rate ($m^3$/h) | Decarburization zone Zone temperature (° C.) | Decarburization zone Ambient gas Type | Decarburization zone Ambient gas Dew point (° C.) |
|---|---|---|---|---|---|---|---|---|---|
| 1 | A | 40 | 900 | $H_2$ | −10 | 50 | 950 | $H_2$ | 50 |
| 2 | B | 40 | 900 | $H_2$ | −10 | 50 | 950 | $H_2$ | 50 |
| 3 | C | 40 | 900 | $H_2$ | −10 | 50 | 950 | $H_2$ | 50 |
| 4 | A | 40 | — | — | — | — | 950 | $H_2$ | 50 |
| 5 | B | 40 | — | — | — | — | 950 | $H_2$ | 50 |
| 6 | C | 40 | — | — | — | — | 950 | $H_2$ | 50 |
| 7 | A | 40 | 900 | Ar | −10 | 50 | 950 | $H_2$ | 50 |
| 8 | D | 40 | 900 | $H_2$ | −10 | 50 | 950 | $H_2$ | 50 |
| 9 | D | 40 | — | — | — | — | 950 | $H_2$ | 50 |

| Heat treatment No. | Conditions of finish heat treatment: Deoxidation zone Zone temperature (° C.) | Deoxidation zone Ambient gas Type | Deoxidation zone Ambient gas Dew point (° C.) | Denitrification zone Temperature at zone exit (° C.) | Denitrification zone Ambient gas introduced into denitrification zone Type | Denitrification zone Ambient gas introduced into denitrification zone Dew point (° C.) | Denitrification zone Ambient gas introduced into denitrification zone Flow rate ($m^3$/h) | Charged amount (ratio relative to reference value) | Remark |
|---|---|---|---|---|---|---|---|---|---|
| 1 | 950 | $H_2$ | −10 | 400 | $H_2$ | −10 | 120 | 1.01 | I.E. |
| 2 | 950 | $H_2$ | −10 | 400 | $H_2$ | −10 | 120 | 0.95 | I.E. |
| 3 | 950 | $H_2$ | −10 | 400 | $H_2$ | −10 | 120 | 0.97 | I.E. |
| 4 | 950 | $H_2$ | −10 | 400 | $H_2$ | −10 | 150 | 1.00 | C.E. |
| 5 | 950 | $H_2$ | −10 | 400 | $H_2$ | −10 | 150 | 0.78 | C.E. |
| 6 | 950 | $H_2$ | −10 | 400 | $H_2$ | −10 | 150 | 0.85 | C.E. |
| 7 | 950 | $H_2$ | −10 | 400 | $H_2$ | −10 | 150 | 1.01 | I.E. |
| 8 | 950 | $H_2$ | −10 | 400 | $H_2$ | −10 | 150 | 0.98 | I.E. |
| 9 | 950 | $H_2$ | −10 | 400 | $H_2$ | −10 | 150 | 0.84 | C.E. |

I.E.: Invention Example
C.E.: Comparative Example

TABLE 2

| Heat treatment No. | Impurity content of raw iron powder (mass %) No. | C | O | N | Impurity content of product iron powder (mass %) C | O | N | Evaluation of quality of product iron powder | Ratio of charged amounts | Evaluation of productivity | Remark |
|---|---|---|---|---|---|---|---|---|---|---|---|
| 1 | A | 0.5 | 0.8 | 0.008 | 0.008 | 0.20 | 0.001 | Good | 1.01 | Good | I.E. |
| 2 | B | 0.5 | 1.2 | 0.008 | 0.006 | 0.28 | 0.001 | Good | 0.95 | Good | I.E. |
| 3 | C | 0.8 | 0.8 | 0.008 | 0.013 | 0.18 | 0.001 | Good | 0.97 | Good | I.E. |
| 4 | A | 0.5 | 0.8 | 0.008 | 0.011 | 0.32 | 0.001 | — (reference) | 1.00 (reference) | — | C.E. |
| 5 | B | 0.5 | 1.2 | 0.008 | 0.008 | 0.30 | 0.001 | Good | 0.78 | Poor | C.E. |
| 6 | C | 0.8 | 0.8 | 0.008 | 0.013 | 0.23 | 0.001 | Good | 0.85 | Poor | C.E. |
| 7 | A | 0.5 | 0.8 | 0.008 | 0.009 | 0.25 | 0.001 | Good | 1.01 | Good | I.E. |
| 8 | D | 0.5 | 0.8 | 0.012 | 0.007 | 0.20 | 0.001 | Good | 0.98 | Good | I.E. |
| 9 | D | 0.5 | 0.8 | 0.012 | 0.009 | 0.20 | 0.001 | Good | 0.84 | Poor | C.E. |

I.E.: Invention Example
C.E.: Comparative Example

In any of Invention Examples, even if a raw iron powder having somewhat high impurity contents is charged, the contents of carbon, oxygen, and nitrogen can be reduced to desired values or less without decreasing the charged amount (produced amount) per unit time. Thus, a high-quality product iron powder can be produced with high productivity. In contrast, in Comparative Examples that are outside the scope of the present invention, when the impurity contents of the raw iron powder are low, the impurity contents of the product iron powder can be reduced to desired values (reference values of heat treatment No. 4) or less without decreasing the charged amount (produced amount) per unit time. However, when the impurity contents of the raw iron powder are high, a product iron powder whose impurity contents are reduced to desired values or less cannot be obtained unless the charged amount (produced amount) per unit time is significantly decreased.

According to the present invention, a product iron powder having desired C, O, and N concentrations can be easily and stably produced with high productivity, regardless of the C, O, and N concentrations of a raw iron powder serving as a raw material iron powder, which produces industrially significant effects. Furthermore, a product iron powder having a stable quality can be provided.

What is claimed is:

1. A finish heat treatment apparatus for an iron powder comprising:

a hopper;

a moving hearth on which a raw iron powder discharged from the hopper is placed and that continuously moves in an internal space of a furnace body;

partition walls disposed in a direction perpendicular to a moving direction of the moving hearth so as to allow the moving hearth to pass therethrough;

three spaces respectively constituted by a decarburization zone, a deoxidation zone, and a denitrification zone formed in that order from an upstream side in the moving direction of the moving hearth, the three spaces being formed by partitioning the internal space of the furnace body in a longitudinal direction with the partition walls, wherein the raw iron powder is subjected to finish heat treatment in each of the spaces;

a pretreatment zone formed by partitioning the internal space of the furnace body with one of the partition walls that allows the moving hearth to pass therethrough, the pretreatment zone being adjacent to the upstream side of the decarburization zone;

a plurality of radiant tubes disposed in each of the three spaces and the pretreatment zone to heat the three spaces and the pretreatment zone;

an ambient gas inlet and an ambient gas outlet disposed on the downstream side of the denitrification zone and on the upstream side of the decarburization zone, respectively, to form a gas passageway in the three spaces so that an ambient gas flows in a direction opposite to the moving direction of the moving hearth;

a water vapor blowing inlet disposed on the downstream side of the decarburization zone to adjust an ambient dew point; and a pretreatment ambient gas inlet disposed on the upstream side of the pretreatment zone.

* * * * *